United States Patent [19]

Shuler

[11] Patent Number: 4,575,980

[45] Date of Patent: Mar. 18, 1986

[54] APPARATUS AND METHOD FOR STRAIGHTENING WARPED DOORS

[76] Inventor: George C. Shuler, 2116 Gilmore Dr., Fort Wayne, Ind. 46818

[21] Appl. No.: 670,343

[22] Filed: Nov. 9, 1984

[51] Int. Cl.[4] ..... E04G 23/00

[52] U.S. Cl. ..... 52/291; 52/222; 52/226

[58] Field of Search ..... 52/291, 222, 225, 226; 49/503

[56] References Cited

U.S. PATENT DOCUMENTS

| | | | |
|---|---|---|---|
| 79,862 | 7/1868 | Ross | 52/291 |
| 275,832 | 4/1883 | Lockwood | 52/291 |
| 430,032 | 6/1890 | Kaiser | 52/291 |
| 1,520,686 | 12/1924 | Andler | 52/291 |
| 2,109,659 | 3/1938 | Adamson | 52/291 |
| 2,319,303 | 5/1943 | Crawford | 52/291 |
| 2,571,142 | 10/1951 | Lando | 52/291 |
| 2,786,242 | 4/1957 | Stephens | 52/291 |
| 3,154,820 | 11/1964 | Schaaf | 52/291 |
| 3,289,353 | 12/1966 | Van Eden | 52/291 |
| 3,471,973 | 10/1969 | Behmlander | 52/291 |
| 4,163,348 | 8/1979 | Thomas, Jr. | 52/291 X |

FOREIGN PATENT DOCUMENTS

| | | | |
|---|---|---|---|
| 2464861 | 6/1981 | France | 52/291 |

*Primary Examiner*—Carl D. Friedman
*Assistant Examiner*—Naoko Slack
*Attorney, Agent, or Firm*—Jeffers, Irish & Hoffman

[57] ABSTRACT

An apparatus and method for straightening warped doors of a residential type includes an elongate member anchored at opposite ends to the top and bottom section of the warped door. Means are provided for adjusting the length of the elongate member to create tension along the length of the door. Spaced pressure blocks slidably maintained along the elongate member rotate about the axis of the elongate member for selectively pressing against the warped surface of the door. Contact of the spaced pressure block means with the door increases tension on the elongate member which in turn exerts increased force against the spaced pressure block means and provides maximum efficiency for straightening the door.

20 Claims, 7 Drawing Figures

APPARATUS AND METHOD FOR STRAIGHTENING WARPED DOORS

BACKGROUND OF THE INVENTION

The present invention generally relates to method and apparatus for straightening warped door, and more particularly, for selectively exerting force against the warped portion of the door to pull out the warp.

In recent years, there has been an increased awareness of the need to conserve energy, and the cost of energy has risen dramatically. Heating and/or cooling a dwelling requires a great amount of energy and is, therefore, very expensive. A portion of the energy used for controlling the temperature of a dwelling is lost through the openings around doors and windows. These air leaks are more pronounced especially around warped doors. One cause of such warping is due to the variance of temperatures between the inner and outer surfaces of the door. Typically in a cold climate, a door bows outwardly during the winter months.

Several methods are known which attempt to straighten warped doors by using a variety of devices. Straightening is usually accomplished by mounting an elongate member to one surface of the warped door to exert force on the door by tensioning the elongate member between the opposite ends. The elongate member of such devices generally span the length of a warped door by some means such as single or multiple rods or cables. Generally, to secure the spanning member to the door, a variety of securing methods have been used including: securing the ends of the spanning member or members to the door; or fastening the spanning member to the door along short spaced intervals. The secured spanning member then is tensioned in some manner to straighten the door. One common way to straighten the warping is by shortening the spanning member by turnbuckles or tension bolts.

One prior art device disclosed in U.S. Pat. No. 3,471,973 to Behmlander appears to add tension to a spanning member by shortening the spanning member with a turnbuckle on a connection means between a yoke and securing clip at one end portion of a door. This device, as well as similar devices, are limited in that they are not adjustable and, therefore, do not efficiently focus pressure against a selected warped portion of the warped door.

Another prior art device disclosed in U.S. Pat. No. 2,571,142 to Lando, includes an elongate presser bar having a channel cross-section and multiple transverse openings therethrough intermediate of its ends, a pair of contact blocks slidably held on the pressure bar by channel flanges, and an elongate spindle to extend through both the regular doorknob aperture and one of the multiple openings aligned with the regular doorknob aperture. This device exerts inward pressure against the presser bar by tightening a pair of nuts secured along the length of the elongate spindle. The slidable contact blocks appear to transmit that inward pressure to the door. The clumsy channel cross-section as well as the multiple transverse openings through the presser bar are unattractive and detract from the beauty of the natural door. The complicated mounting required by this device also detracts from its convenience. Lateral grooves in the contact blocks receive the channel flanges and thus limit the contact blocks to reciprocating movement along the longitudinal axis of the elongate presser bar. The spindle connection with the presser bar and the door must be loosened even to slidingly reposition the contact blocks.

Some devices which allegedly straighten doors exert force along an elongate member between its attachment at opposite ends on the door by fasteners such as screws. Because even a limited amount of force has been known to strip out such screws, these devices are strictly limited in the amount of tension they can sustain between the opposite ends of attachment of the elongate member. Some devices try to overcome this problem by using multiple elongate members interconnected end-to-end by turnbuckles or tension bolts or by securing sections of an elongate member along the length of the warped door. Other such devices use additional screws to secure the ends of multiple elongate rods, or along a single elongate rod. Often such devices effectively become a permanent part of the door either because multiple mounting holes scar the door, or the mounting requirements are too complex to permit easy installation and removal.

Consequently, a need exists for an apparatus for straightening warped doors which is effective, efficient and economical, and which will use a minimum number of parts to produce a sufficient amount of force directly on a warped portion of the door.

SUMMARY OF THE INVENTION

The present invention overcomes the problems and disadvantages of the door straightening devices which are known in the art by providing an improved apparatus and method for straightening warped doors. The device of the present invention in one form thereof provides an elongate member to be mounted and tensioned on the convex surface of a warped door (typically, the colder exterior surface in the Winter), and pressure blocks slidably and rotatably connected to the elongate member selectively focus pressure against warped door portions of the door.

The apparatus of the present invention, in one form thereof, is easily secured to or removed from the convex surface of a warped door. This feature permits the present invention to be mounted on alternate faces of the door depending on the direction of the warping. An air conditioned home in the Summer may have warping due to the cold interior surface compared to the hot exterior surface of the door whereas the opposite is true in the Winter. One obscure hole at the top and bottom end portions of the door, out of the normal line of vision, is sufficient to mount the elongate member of this device. Spaced pressure blocks slidably secured along the elongate member selectively press against selected portions of the warped door and distribute the forces exerted by adjusting the length of the elongate member between the mounted ends. Such distribution of force by the spaced pressure blocks prevents undue strain on the fasteners such as screws and allows them to withstand greater tension without stripping out.

In an alternate form of the invention there is provided an apparatus for straightening warped doors which comprises an elongate member having opposite end portions. Each of the opposite end portions of the elongate member are adapted to secure the elongate member on a convex surface of a warped door. An adjusting portion is secured to the elongate member for adjusting the length of the elongate member between the opposite end portions. Pressure means are slidably mounted on the elongate member for pressing against a selected portion of the warped door, and for increasing tension on the elongate member by causing the elongate member to bow outwardly and pull the warp out of the door.

Accordingly, the present invention relates to apparatus and method for straightening doors which include the operative steps of: mounting an elongate member having spaced pressure block means received thereon to one face of the warped door, then adjusting the length of the elongate member, and then creating additional tension on the elongate member. The invention may also include the step of repositioning the spaced pressure block means over a different warped portion of the door.

It is an object of the present invention to provide an improved apparatus for straightening warped doors which is also economical.

It is another object of this invention to provide an apparatus for straightening warped doors which is easy to secure to the door.

It is a further object of this invention to provide an apparatus for straightening warped doors which requires a minimum number of parts.

It is a still further object of this invention to provide an apparatus for straightening warped doors which can selectively focus pressure against the warped portion of the door.

It is yet a further object of this invention to provide an apparatus for straightening warped doors which does not interfere with either the normal operation of the door or use of the doorknob.

It is still another object of this invention to provide an attractive apparatus which has a slim line for straightening warped doors and which requires no maintenance.

DETAILED DESCRIPTION OF AN EMBODIMENT

Figure 1:
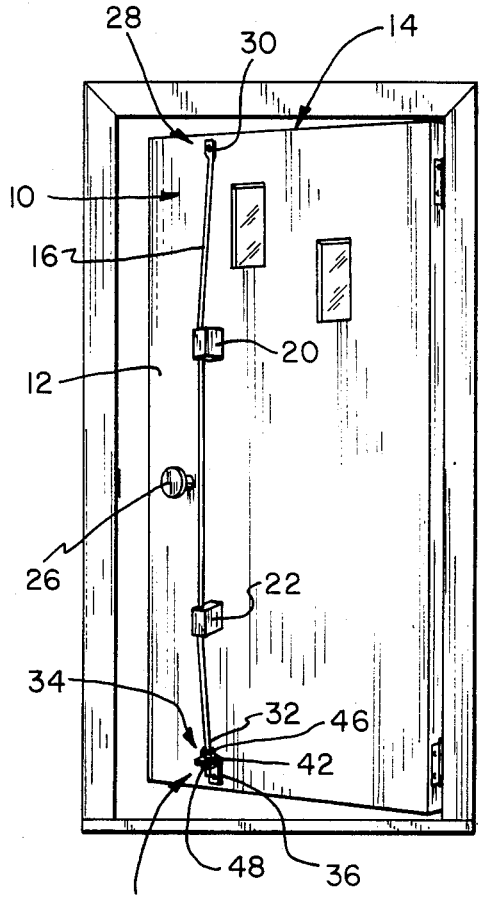
FIG. 1 is a perspective view of one embodiment of the apparatus mounted on a warped door.
Figure 2:
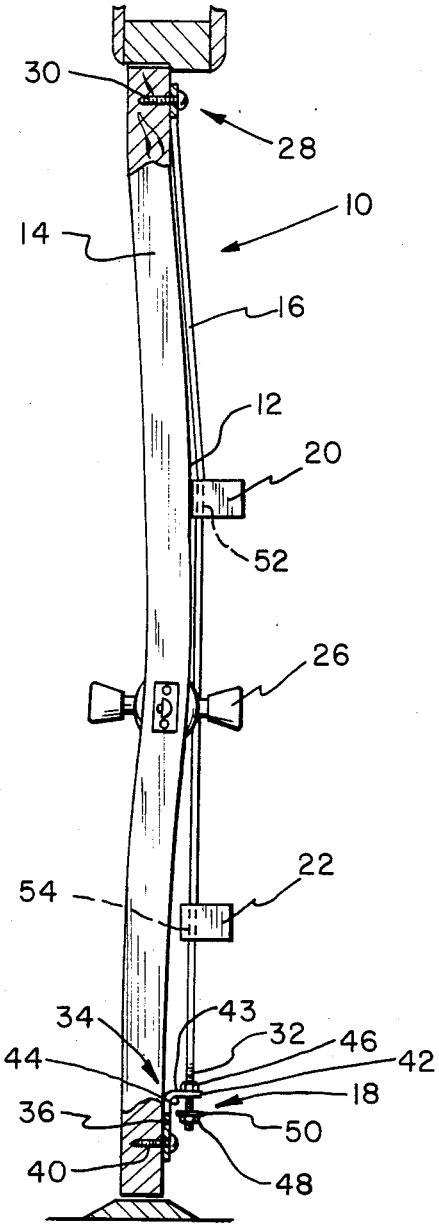
FIG. 2 is a side elevational view partially in section of the apparatus in FIG. 1 in an unstressed condition on the door.
Figure 6:
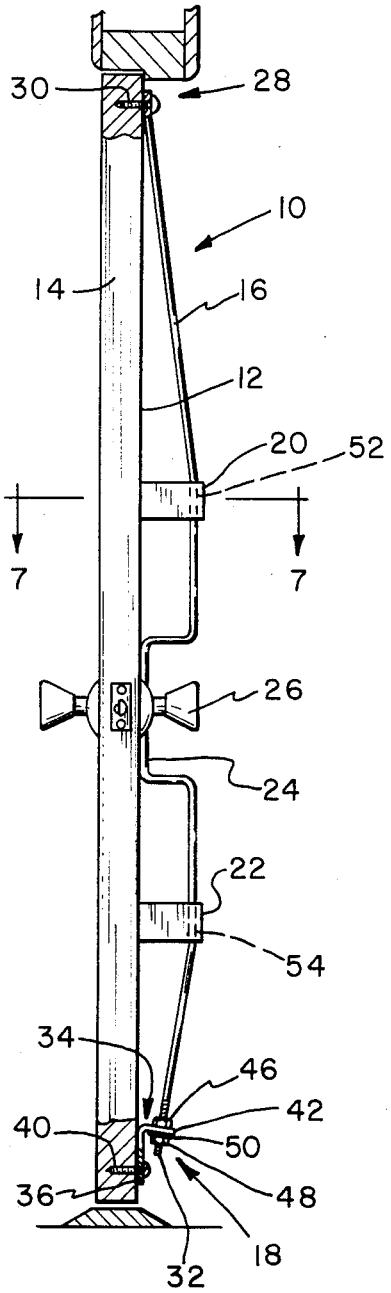
FIG. 6 is a side view of an alternate embodiment of the apparatus in FIG. 1 in a stressed condition on the door.
Figure 7:
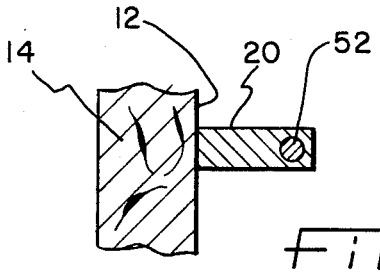
FIG. 7 is a sectional view taken along the line 7—7 of FIG. 6 and viewed in the direction of the arrows.

Referring now to the drawings, and more particularly to FIGS. 1 and 2, apparatus 10 for straightening warped doors is shown mounted on the convex surface 12 of warped door 14. Apparatus 10 includes elongate member 16, such as stainless steel rod, adjusting portion 18 and spaced pressure blocks 20, 22. Spaced pressure blocks 20, 22 selectively increase tension on mounted elongate member 16 by causing elongate member 16 to bow away from convex surface 12. Spaced pressure blocks 20, 22 also selectively press against selected warped portions of warped door 14. FIG. 6 illustrates an alternative embodiment of this invention wherein elongate member 16 includes offset portion 24 generally adjacent doorknob 26.

Figure 4:
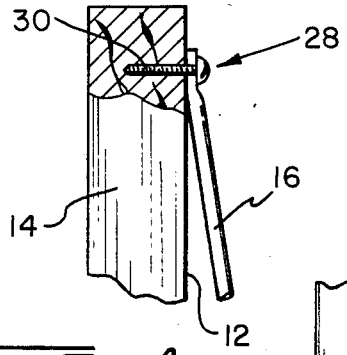
FIG. 4 is an enlarged detailed view of the attachment portion of one end of the apparatus.

Referring now to FIG. 4, there is shown flattened end portion 28 of elongate member 16 having a transverse opening therethrough (not shown). Flattened end portion 28 can be secured to one of the top and bottom end portions of door 14 by any suitable securing device 30 such as a screw, bolt and the like.

Figure 5:
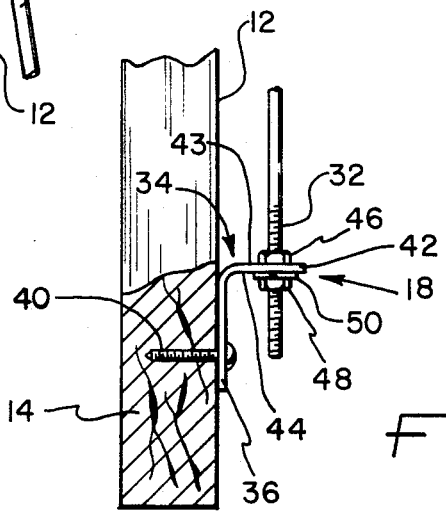
FIG. 5 is an enlarged detailed view of the opposite end attachment portion of the apparatus.

Referring now to FIG. 5, there is shown threaded end portion 32 of elongate member 16, and bracket member 34 securing threaded end portion 32 to the other of the top and bottom end portions of warped door 14. Bracket member 34 has bracket leg 36 having a transverse opening therethrough (not shown) for securing bracket leg 36 to convex surface 12 by any suitable securing device 40 such as a screw, bolt and the like which extends into warped door 14. Bracket member 34 also has bracket arm 42 with upper surface 43, lower surface 44 and a transverse clearance opening therethrough (not shown) receiving threaded end portion 32.

Apparatus 10 is easily secured to convex surface 12, therefore, by drilling two inconspicuous holes (out of the normal line of vision as approaching the door 14) in the top and bottom sections of warped door 14. The drawings illustrate flattened end 28 secured at the top portion of door 14, and bracket member 34 with threaded end portion 32 secured to the bottom end section of door 14. It is to be understood that this mounting arrangement can be reversed.

Adjusting portion 18 for adjusting the length of elongate member 16 between flattened end portion 28 and threaded end portion 32 includes nuts 46, 48, lock washer 50 and threaded end portion 32 received in bracket arm 42. Nut 46 threadably secures to threaded end portion 32 above upper surface 43. Nut 48 and lock washer 50 threadably secure to threaded end portion 32 below lower surface 44. Twisting of bracket member 34 when tensioning elongate member 16 is prevented by tightening nut 46 to clamp bracket arm 42 securely between nuts 46, 48 to keep bracket arm 42 substantially perpendicular to elongate member 16. It is possible, therefore, to adjust the tension on elongate member 16 while apparatus 10 remains mounted on door 14. It is to be understood that other tensioning devices such as turnbuckles, tension bolts and the like could be used to tension elongate member 16.

Figure 3:
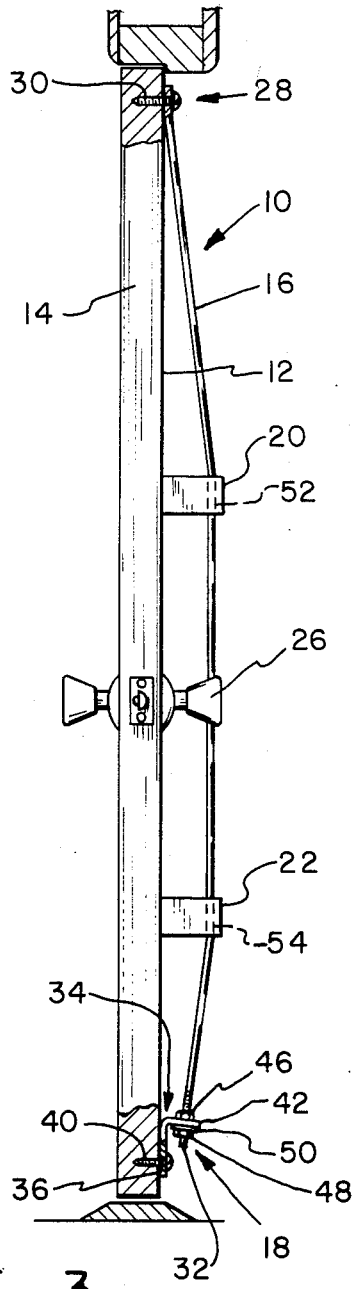
FIG. 3 is a side elevational view partially in section of the apparatus in FIG. 1 in a stressed condition on the door.

Spaced pressure blocks 20, 22 have eccentric openings 52, 54, respectively, of sufficient diameter to receive elongate member 16. Referring now to FIGS. 2 and 3, openings 52, 54 allow spaced pressure blocks 20, 22, respectively, to independently rotate about and slide along the axis of elongate member 16.

When elongate member 16 is mounted on warped door 14, spaced pressure blocks 20, 22 are preferably rotated out of engagement with convex surface 12. After tensioning elongate member 16 to hold it tautly in its mounting on door 14, spaced pressure blocks 20, 22 easily slide into position over a warped portion of door 12 and can be rotated to press against selected convex portions of door 14.

Rotating spaced pressure blocks 20, 22 to press against selected portions of door 14 also increases tension on elongate member 16. Elongate member 16 bows outwardly as it spans spaced pressure blocks 20, 22 and tension increases on elongate member 16. This increased tension causes elongate member 16 to pull out the warp from the door by pulling against the top and bottom of the door and pressure increasing on spaced pressure blocks 20, 22. Spaced pressure blocks 20, 22 distribute this pressure against convex surface 12. This concept increases the efficiency of apparatus 10 in correcting the warped portion of door 14.

One of the major advantages of this invention is the flexibility of positioning spaced pressure blocks 20, 22 to get the maximum effect from the tension exerted on elongate member 16 to pull out the warp from the door 14. Another advantage of apparatus 10 is that spaced pressure blocks 20, 22 can be repositioned without removing apparatus 10 from door 14. Spaced pressure blocks 20, 22 can also be repositioned said door 14, without further adjusting the length of elongate member 16 and without scarring convex surface 12.

When spaced pressure blocks 20, 22 press against convex surface 12, openings 52, 54, respectively, receive and hold elongate member 16 preferably approximately $1\frac{1}{4}$ to $1\frac{1}{2}$ inches from convex surface 12. While there are shown two space pressure blocks 20, 22, it is to be understood that additional pressure block means can be used, and that in some cases, only one pressure block may be necessary. Preferably all members of apparatus 10 are of non-corrosive metal such as stainless steel. Elongate member 16 preferably is a stainless steel rod which has a round cross-section with preferably a $\frac{1}{4}''$ diameter which facilitates rotation about its axis by spaced pressure blocks 20, 22.

Offset portion 24 in an alternate embodiment of this invention, preferably is offset approximately 1 inch from the longitudinal axis of elongate member 16. In one form of this invention, suitable securing means such as eye bolts, hooks and the like (not shown) can be used to hold offset portion adjacent convex surface 12. While offset portion 24 has been illustrated to have a U-shape configuration, any alternate shape configuration suitable to provide clearance adjacent the doorknob could be used.

Tension on elongate member 16 can be increased by sliding spaced pressure blocks 20, 22 toward threaded end portion 32 and flattened end 28, respectively. Conversely, therefore, tension on elongate member 16 can be decreased by sliding spaced pressure blocks 20, 22 away from threaded end portion 32 and flattened end portion 28, respectively. In the embodiment shown in FIGS. 1–3, spaced pressure blocks 20, 22 can also be moved to the same section of elongate member 16 relative to portion 24, as shown in FIG. 6, and one of flattened end portion 28 and threaded end portion 32. The amount of warp on the door as well as the location of the serious warping will dictate the positioning of spaced pressure blocks 20, 22 for the maximum straightening effect.

While alternate embodiments of this invention have been described, it will be understood that it is capable of further modifications. This application is, therefore, intended to cover any variations, uses, or adaptations of the invention following the general principles thereof, and including such departures from the present disclosure as come within known or customary practice in the art to which this invention pertains and fall within the limits of the appended claims.

What is claimed is:

1. An apparatus for straightening warped doors, said apparatus comprising:

an elongate member having opposite end portions, said opposite end portions adapted for mounting said elongate member on a warped door;

means on said elongate member for adjusting the length of said elongate member between said opposite end portions; and spaced pressure block means slidably mounted on said elongate member for pressing against a selected portion of a warped door and for increasing tension on said elongate member by causing said elongate member to bow outwardly and pull the warp out of the door, said pressure block means each including a plurality of sides and an opening therethrough positioned closer to one of said sides than to another of said sides, said opening slidably receiving said elongate member therethrough and enabling said spaced pressure block means to rotate about the axis of said elongate member.

2. The apparatus of claim 1, wherein said apparatus includes bracket means connected to one of said opposite end portions for anchoring said one end portion to one of top and bottom end portions of a warped door.

3. The apparatus of claim 2, wherein said means for adjusting the length of said elongate member comprises a pair of cooperating nuts threadably secured on said one end portion and connected to said bracket.

4. The apparatus of claim 2, wherein the other opposite end portion of said elongate member has a flattened section having a transverse opening therethrough, said opening adapted to accommodate a fastener means for anchoring said flattened end portion to the other of top and bottom end portions of a warped door.

5. The apparatus of claim 1, wherein said elongate member further comprises an offset portion at about midpoint between said opposite end portions, said offset portion adapted to be positioned adjacent a doorknob on a warped door, and to provide clearance to grasp the doorknob.

6. In combination with a door, an apparatus for straightening a warp out of said door, said apparatus comprising:

an elongate member having opposite end portions anchored to top and bottom end portions of the warped door;

means on one of said elongate member opposite end portions for adjusting the length of said elongate member between the anchored end portions; and spaced pressure block means slidably mounted on said elongate member for selectively pressing against a warped portion of the door and for bowing said elongate member outwardly away from the door thereby increasing tension on said elongate member to pull the warp out of the door, said spaced pressure block means each including a plurality of sides and having an opening therethrough positioned closer to one of said sides than to another of said sides, said opening slidably and rotatably receiving said elongate member.

7. The combination of claim 6, wherein one of said end portions is threaded and further comprising a bracket means connected to said threaded end portion of said elongate member for anchoring said threaded end portion to one of the top and bottom end portions of the warped door.

8. The combination of claim 7, wherein said length adjusting means comprises a nut threadably secured on said threaded end portion and connected to said bracket.

9. The combination of claim 7, wherein said length adjusting means comprises a pair of cooperating nuts threadably secured on said threaded end portion and connected to opposite sides of said bracket.

10. The combination of claim 6, wherein said door has a doorknob, and said elongate member further comprises an offset portion between said opposite end portions and adjacent said doorknob.

11. The combination of claim 6, wherein said apparatus is removably mounted on the door.

12. In combination with a door, an apparatus for straightening a warp out of said door, said apparatus comprising:

an elongate member having a substantially round crossection and opposite end portions anchoring said elongate member to a top and a bottom portion of said warped door;

means threadably secured on one of said opposite end portion of said elongate member for adjusting the length of said elongate member between the anchored end portions; and spaced pressure block means, each having an eccentrically positioned opening therethrough, said openings being axially aligned and receiving said elongate member therein, said spaced pressure block means being slidably and rotatably connected to said elongate member for rotating into contact with and pressing against a selected portion of said door for pulling out the warp from the door.

13. The combination of claim 12, wherein said door has a doorknob and said elongate member further comprises an offset portion between said opposite end portions and adjacent said doorknob.

14. A method for straightening a warped door, comprising the steps of:

anchoring opposite end portions of an elongate member to top and bottom end portions of a warped door, said elongate member having spaced pressure block means including a block having a plurality of sides and an opening therethrough closer to one of said sides than to another of said sides, said opening slidably and rotatably receiving said elongate member;

adjusting the length of said elongate member between said opposite end portions;

sliding and positioning said spaced pressure block means over the warped portion of the door; and then rotating said spaced pressure block means to positions bridging between said elongate member and said warped portion of the door to increase tension on said elongate member by bowing said elongate member outwardly away from the door and causing said spaced pressure block means to press against said door to straighten out the warp.

15. The method for straightening warped doors as recited in claim 14, wherein one of said opposite end portions of said elongate member is threaded and is connected to a bracket anchored to one of the top and bottom end portion of said warped door, and wherein the step of adjusting the length of said elongate member includes threadably adjusting a pair of cooperating nuts on the threaded end of said elongate member.

16. The method for straightening warped doors as recited in claim 14, including the step of repositioning said spaced pressure block means over the warped portion of said door, said step comprising:

rotating said spaced pressure block means about said elongate member mounted on said door and out of pressing contact with said door;

then sliding said pressure block means along the axis of said mounted elongate member to reposition them over a different portion of said door; and then rotating said pressure block means about the axis of said mounted elongate member and into pressing contact with said different portion of said door.

17. An apparatus for straightening warped doors, said apparatus comprising:

an elongate member having opposite end portions, said opposite end portions adapted for mounting said elongate member on a warped door;

means on said elongate member for adjusting the length of said elongate member between said opposite end portions; and spaced pressure block means slidably mounted on said elongate member for pressing against a selected portion of a warped door and for increasing tension on said elongate member by causing said elongate member to bow outwardly and pull the warp out of the door, said pressure block means each including an eccentrically positioned opening therethrough, said openings being in axial alignment and having adequate diameter for slidably receiving said elongate member therethrough and for enabling said spaced pressure block means to rotate about the axis of said elongate member.

18. The apparatus of claim 17, wherein said apparatus includes bracket means connected to one of said opposite end portions for anchoring said one end portion to one of top and bottom end portions of a warped door.

19. The apparatus of claim 18, wherein said means for adjusting the length of said elongate member comprises a pair of cooperating nuts threadably secured on said one end portion and connected to said bracket.

20. The apparatus of claim 17, wherein said elongate member further comprises an offset portion at about midpoint between said opposite end portions, said offset portion adapted to be positioned adjacent a doorknob on a warped door, and to provide clearance to grasp the doorknob.

* * * * *